US008459502B2

(12) United States Patent
Swanick

(10) Patent No.: US 8,459,502 B2
(45) Date of Patent: Jun. 11, 2013

(54) RECLOSABLE DISPENSING CLOSURE WITH VENT

(75) Inventor: Kenneth P. Swanick, Arlington Heights, IL (US)

(73) Assignee: Calibre Closures, LLC, Roselle, IL (US)

( * ) Notice: Subject to any disclaimer, the term of this patent is extended or adjusted under 35 U.S.C. 154(b) by 0 days.

(21) Appl. No.: 13/361,425

(22) Filed: Jan. 30, 2012

(65) Prior Publication Data

US 2012/0181303 A1 Jul. 19, 2012

Related U.S. Application Data

(63) Continuation-in-part of application No. 12/875,862, filed on Sep. 3, 2010.

(60) Provisional application No. 61/437,992, filed on Jan. 31, 2011.

(51) Int. Cl.
*B67D 1/00* (2006.01)

(52) U.S. Cl.
USPC ..... 222/83; 222/484; 222/536

(58) Field of Classification Search
USPC ..... 222/83, 484, 534, 536, 81, 82
See application file for complete search history.

(56) References Cited

U.S. PATENT DOCUMENTS 1,250,081 A * 12/1917 Bennis ..... 222/488
1,259,057 A * 3/1918 Vick ..... 222/83
2,701,668 A * 2/1955 Zayan ..... 222/484
2,971,664 A * 2/1961 Jacob ..... 222/482
3,089,626 A * 5/1963 Kubiliunas ..... 222/484
3,227,317 A 1/1966 Bereziat et al.
3,369,707 A 2/1968 Porter et al.
3,383,007 A 5/1968 Salamone
3,472,411 A 10/1969 Turner
3,581,605 A 6/1971 Taylor
3,653,546 A * 4/1972 Hazard ..... 222/83
3,659,750 A * 5/1972 La Vange ..... 222/153.06
3,734,359 A * 5/1973 Waterman ..... 222/484
3,774,822 A * 11/1973 Hazard ..... 222/541.6
4,221,291 A 9/1980 Hunt
4,271,984 A * 6/1981 Ducros et al. ..... 222/94

(Continued)

OTHER PUBLICATIONS

Int'l Search Report & Written Opinion issued is application No. PCT/US10/47857 (2010).

(Continued)

*Primary Examiner* — Kevin P Shaver
*Assistant Examiner* — Daniel R Shearer
(74) *Attorney, Agent, or Firm* — Barnes & Thornburg LLP

(57) ABSTRACT

A dispensing closure for a vessel comprising a base member engageable with the vessel and a flip top spout member defining a flow channel. The spout member engaged with the base member and pivotable relative to the base member for dispensing fluid from the vessel. The spout member including a rupture membrane and the base member having an actuator for rupturing the rupture membrane during pivoting of the spout member to define a flow opening in the base member in fluid communication with the flow channel and to permit fluid flow through the flow opening. The spout member defining a vent positioned to be in communication with the flow opening when the spout member is pivoted to the flow position to permit air to pass through the vent channel. The rupture member configured to prevent fluid from passing into the vent channel.

18 Claims, 4 Drawing Sheets

U.S. PATENT DOCUMENTS

| | | | | |
|---|---|---|---|---|
| 4,506,809 | A | 3/1985 | Corsette | |
| 4,519,529 | A * | 5/1985 | Seltz | 222/484 |
| 4,747,497 | A | 5/1988 | Holman | |
| 5,020,681 | A | 6/1991 | Kusz | |
| 5,065,881 | A * | 11/1991 | Tarng | 220/258.5 |
| 5,141,138 | A | 8/1992 | Odet et al. | |
| 5,398,829 | A | 3/1995 | Stubbs | |
| 5,482,176 | A | 1/1996 | Maietta et al. | |
| 5,797,521 | A * | 8/1998 | Sobral | 222/531 |
| 6,334,555 | B1 | 1/2002 | Randall et al. | |
| 6,367,622 | B1 | 4/2002 | Hsu | |
| 6,422,412 | B1 | 7/2002 | Sagawa | |
| 6,471,101 | B1 * | 10/2002 | Vardanyan | 222/541.2 |
| 6,477,743 | B1 | 11/2002 | Gross et al. | |
| 6,513,650 | B2 | 2/2003 | Mollstam et al. | |
| 6,571,994 | B1 | 6/2003 | Adams et al. | |
| 6,679,375 | B1 | 1/2004 | Coory | |
| 6,702,161 | B2 | 3/2004 | Adams et al. | |
| 6,745,923 | B2 | 6/2004 | Julian | |
| 6,786,330 | B2 | 9/2004 | Mollstam et al. | |
| 6,793,104 | B2 * | 9/2004 | Kao | 222/481.5 |
| 6,851,576 | B2 | 2/2005 | Dubach | |
| 6,896,161 | B2 * | 5/2005 | Patz | 222/484 |
| 7,178,683 | B2 | 2/2007 | Birkmayer et al. | |
| 7,207,465 | B2 | 4/2007 | Weist | |
| 7,261,226 | B2 | 8/2007 | Adams et al. | |
| 7,337,921 | B2 | 3/2008 | Ma | |
| 7,367,964 | B2 | 5/2008 | Heinz et al. | |
| D571,199 | S | 6/2008 | Petrosino et al. | |
| 7,410,071 | B1 | 8/2008 | Seib et al. | |
| 2003/0000963 | A1 | 1/2003 | Julian | |
| 2003/0106911 | A1 | 6/2003 | Adams et al. | |
| 2006/0057257 | A1 | 3/2006 | Ma | |
| 2007/0045134 | A1 | 3/2007 | Dvorak et al. | |
| 2007/0181522 | A1 | 8/2007 | Davidson | |
| 2008/0124432 | A1 | 5/2008 | Ma | |
| 2008/0156802 | A1 | 7/2008 | Yauk et al. | |
| 2009/0020495 | A1 | 1/2009 | Cheng | |
| 2009/0050648 | A1 | 2/2009 | Wisniewski | |

OTHER PUBLICATIONS

Office Action of Dec. 26, 2012 in U.S. Appl. No. 12/875,862.

* cited by examiner

RECLOSABLE DISPENSING CLOSURE WITH VENT

CROSS REFERENCE TO RELATED APPLICATIONS

This Application claims priority from U.S. Provisional Patent Application Ser. Nos. 61/437,992 filed Jan. 31, 2011, and is a continuation-in-part application of U.S. patent application Ser. No. 12/875,862 filed Sep. 3, 2010.

BACKGROUND

Dispensing closures have been employed with a wide variety of products, including water, juices, condiments, and detergents. These dispensers allow the closure to be opened and closed without removing or separating any portion of the closure from the vessel.

There are several styles of dispensing closures currently commercially available. Pull/push, screw type and flip top are some common variations. These popular designs typically include a base and a spout assembled together. These designs rely upon multiple sealing surfaces to create an airtight closure for distribution and handling of the product. There are disadvantages associated with such designs. For example, upon dispensing the fluid from the vessel, a negative pressure condition or vacuum is created. Therefore, in order to dispense fluid, the vessel must be squeezed to force the fluid out. A portion of the contents exits the vessel upon squeezing, and upon release of the vessel, air re-enters to displace the fluid that has been dispensed. This cycle must be repeated numerous times to empty the contents of the vessel. Another disadvantage may be that the sealing assembly is not consistent because of manufacturing tolerances, slight burrs, and other manufacturing and assembly irregularities.

Bottling companies prefer to pressurize their products prior to shipment, which prevents damage to the product during transit. Additionally, pressurization would allow the bottler to reduce the wall thickness of the dispensing bottle, and rely on internal pressure to support the product during transit and handling. Current designs cannot hold adequate pressure to satisfactorily accomplish these needs. In addition, carbonated beverages and solutions cannot be marketed in these closures, because they would rapidly lose their carbonation and be rendered useless to the consumer.

SUMMARY

The present disclosure is directed to a dispensing closure for a plastic bottle or other vessel containing fluid. The dispensing closure comprises a base member engageable with the vessel and a spout member defining a flow channel. The spout member may be a flip top spout or be in any other form. The spout member is pivotally secured to or otherwise engaged with the base member and is pivotable relative to the base member from a closed position to a flow position for dispensing fluid from the vessel through the flow channel. Either the base member or the spout member includes a rupture membrane and the other of the base member and the spout member has an actuator for rupturing the rupture membrane during pivoting of the spout member to the flow position to define a flow opening in said one of the base member and the spout member in fluid communication with the flow channel and to permit fluid flow through the flow opening and into the flow channel.

The spout member also defines a vent channel in communication with the flow opening when the spout member is pivoted to the flow position to permit air to pass through the vent channel. The vent channel includes two openings defined by the spout member. One of the openings is in communication with the vessel when the spout member is pivoted to the flow position. The spout member may include an engaging portion that includes a circular or other arcuate portion to facilitate pivoting and a neck portion, and the actuator may be being disposed on the arcuate portion. The vent channel may be defined by the engaging portion and said one of the openings may be defined by the actuator. The vent channel may include a first channel portion that extends substantially parallel to the neck portion and a second channel portion that extends perpendicular to the first channel portion. The diameter of the first channel may be less than a diameter of the second channel.

The rupture membrane is hingedly attached to a portion of the base member after the rupture membrane has been ruptured. It may be positioned adjacent said one of the openings and is configured to function as a check valve to prevent fluid from passing from the vessel into the vent channel when the spout member is pivoted to the flow position. Areas of reduced thickness may be disposed about the rupture membrane configured to be broken when the spout member is pivoted to the flow position to rupture the rupture membrane.

Features and advantages of the disclosure will be set forth in part in the description which follows and the accompanying drawings described below, wherein embodiments of the disclosure is described and shown, and in part will become apparent upon examination of the following detailed description taken in conjunction with the accompanying drawings.

BRIEF DESCRIPTION OF THE DRAWINGS

The present disclosure and advantages thereof will become more apparent upon consideration of the following detailed description of an illustrated embodiment when taken in conjunction with the accompanying drawings.

DETAILED DESCRIPTION

Figure 1:
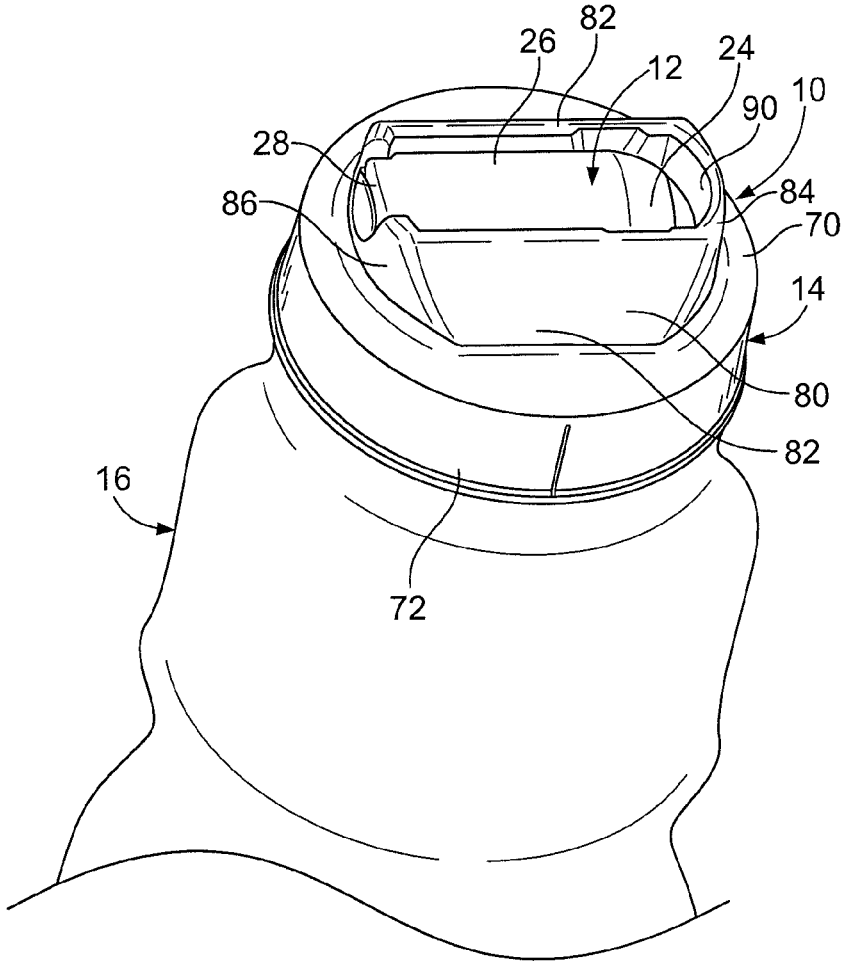
FIG. 1 is a perspective view of a dispensing closure in accordance with an illustrated embodiment of the present disclosure, shown secured to a bottle and shown in a closed position.
Figure 2:
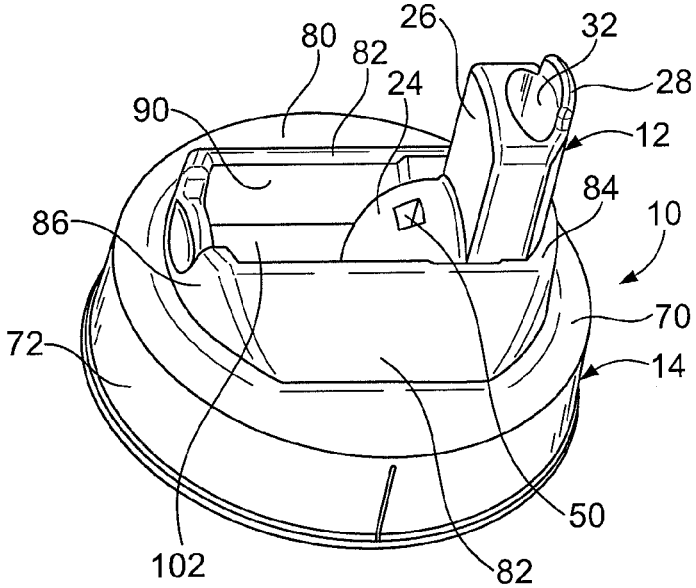
FIG. 2 is a perspective view of the dispensing closure of FIG. 1 shown in an open or flow position.
Figure 3:
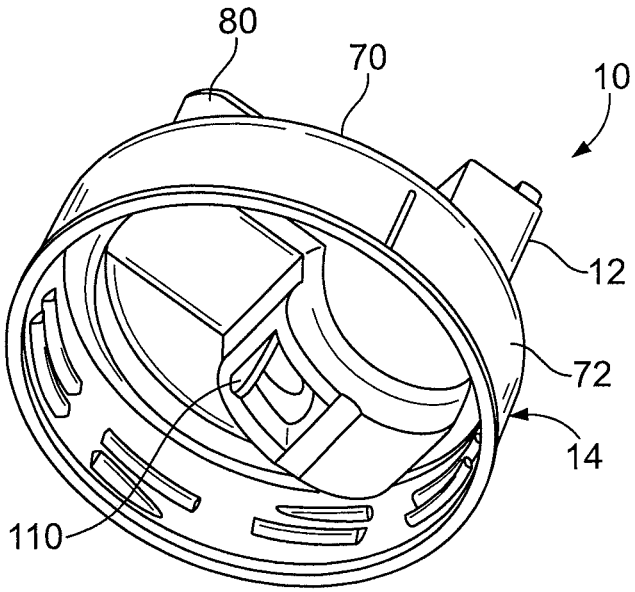
FIG. 3 is a bottom perspective view of the dispensing closure of FIG. 1, shown in an open or flow position.
Figure 4:
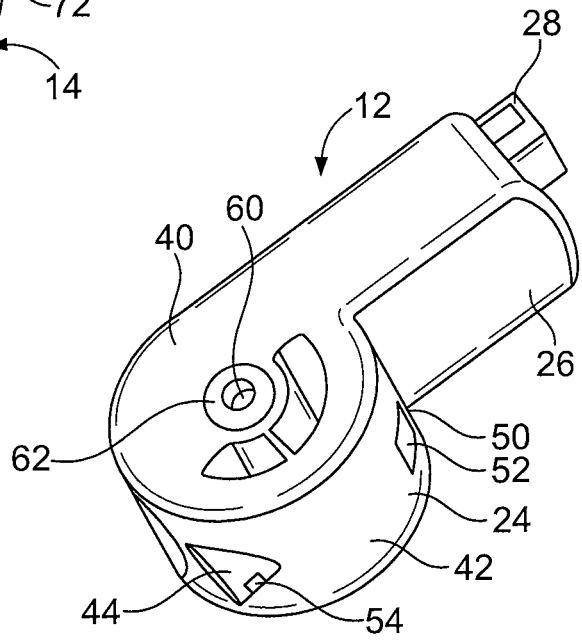
FIG. 4 is a perspective view of the base member and the spout member of the dispensing closure of FIG. 1 shown separated for illustrative purposes.
Figure 4:
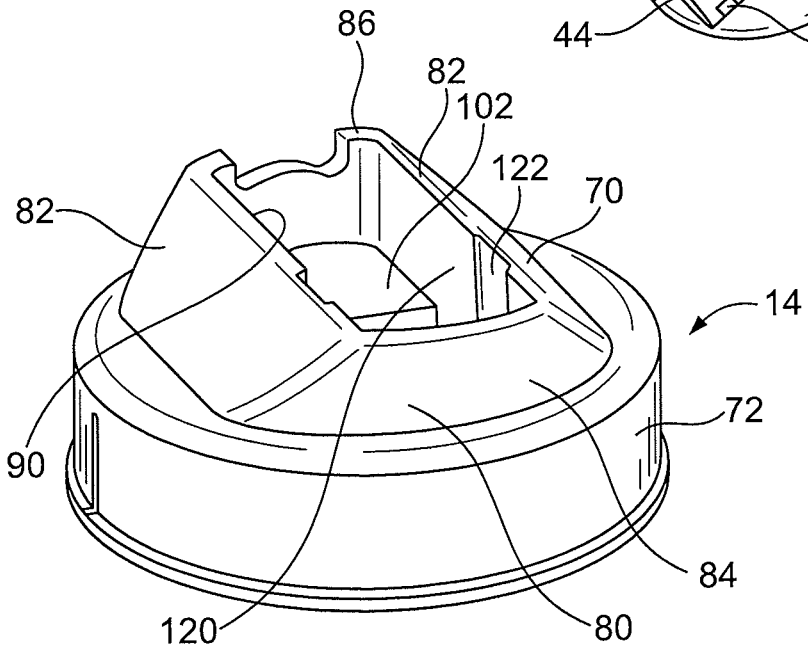
Figure 5:
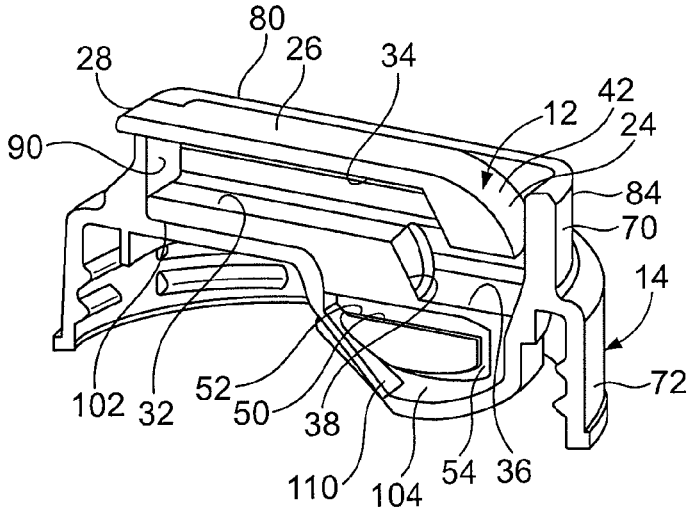
FIG. 5 is a section view of the dispensing closure of FIG. 1 in the closed position.
Figure 6:
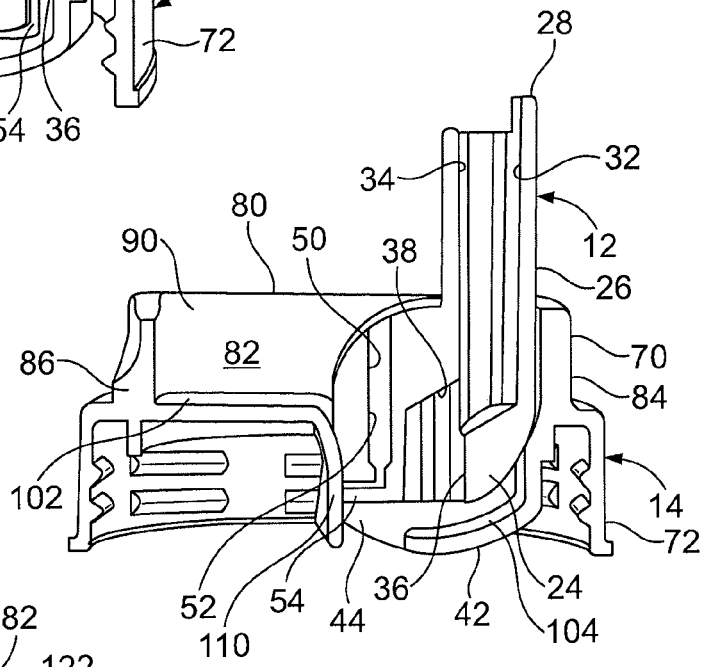
FIG. 6 is a section of the dispensing closure of FIG. 1 in the open position.
Figure 7:
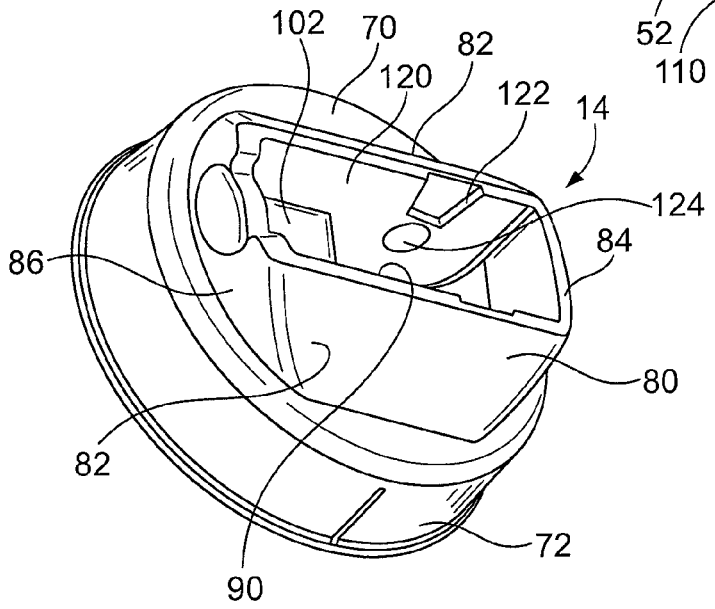
FIG. 7 is a top perspective view of the base member of the dispensing closure of FIG. 1.
Figure 8:
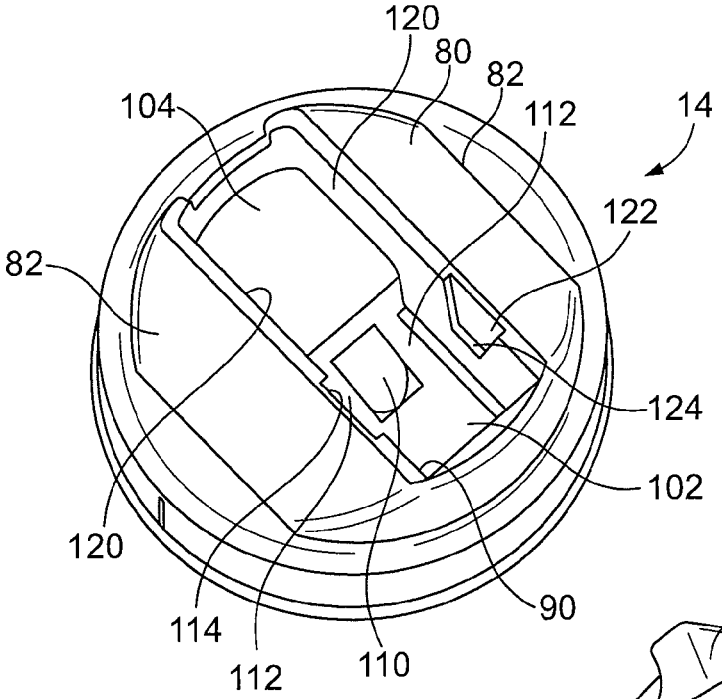
FIG. 8 is an other top perspective view of the base member of the dispensing closure of FIG. 1.
Figure 9:
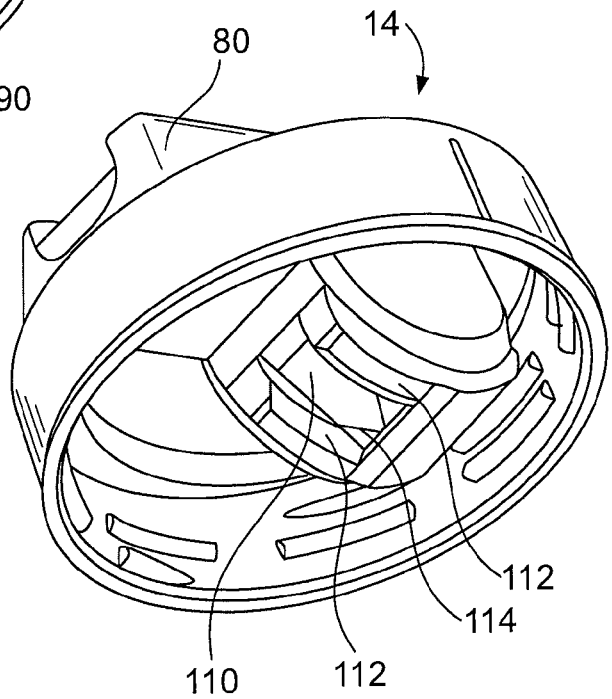
FIG. 9 is a bottom perspective view of the base member of the dispensing closure of FIG. 1.
Figure 10:
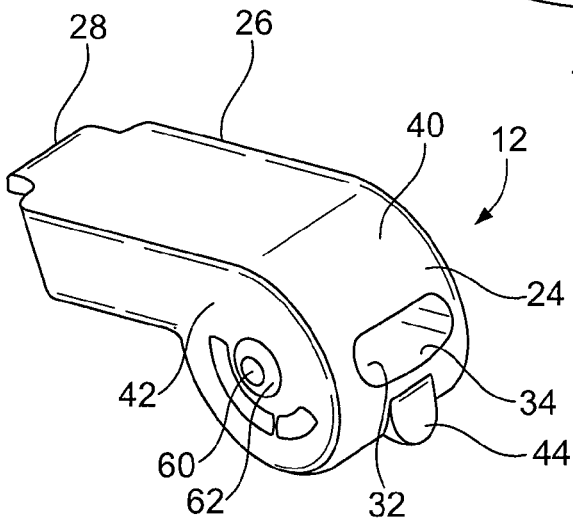
FIG. 10 is an other perspective view of the spout of the dispensing closure of FIG. 1.

While the present disclosure may be susceptible to embodiment in different forms, there is shown in the drawings and slides, and will be described herein in additional detail, one or more embodiments with the understanding that the present description is to be considered an exemplification of the principles of the disclosure and is not intended to be exhaustive or to limit the disclosure to the details of construction and the arrangements of components set forth in the following description or illustrated in the drawings and slides.

FIGS. 1-10 illustrate a dispensing closure 10 in accordance with an illustrated embodiment of the present disclosure comprising a spout member 12 and a base member 14. The illustrated spout member 12 is in the form of a flip top spout, pivotally secured to the base member 14 and pivotable relative to the base member between a closed position and an open or flow position. With reference to FIG. 1, the dispensing closure 10 is for securing to a vessel in the form of a bottle 16 or the like containing a beverage, a condiment or any other form of liquid product. The bottle 16 or other vessel is constructed of any suitable plastic or the like or alternately may be constructed of glass or any other suitable material. The bottle 16 or other vessel may have any suitable construction and defines an open end for dispensing contents through the dispensing closure 10 as described below.

In the illustrated embodiment, the spout member 12 is generally "b-shaped" (or "d-shaped" depending on the view) and includes a circular engaging portion 24 and a neck 26 extending from the engaging portion 24. The neck 26 includes a lip 28 at its lead end to facilitate pivoting of the spout member 12 from the closed position to the open position. The spout member 12 defines a fluid flow channel 32 extending through the engaging portion 24 and through the neck 26. The illustrated fluid flow channel 32 includes parallel segments 34, 36 connected by an angular segment 38 to complement the configuration of the spout member 12. The engaging portion 24 includes a pair of sides 40 and an arcuate surface 42 extending perpendicular to, and interconnecting, the sides for facilitating pivoting movement. The arcuate surface 42 includes an actuator 44. The sides 42 are illustrated with cut out portions for manufacturing economies.

The engaging portion 24 also defines a vent channel 50 for permitting air to flow therethrough including a first portion 52 and a second portion 54. The first portion 52 extends generally parallel to the neck 26 and terminates in an open end. The second portion 54 extends substantially perpendicular to the first portion 52 and extends through the actuator 44 and terminates in an open end defined by the actuator 44. The open end faces a direction perpendicular to segments 34, 36 and to the neck 26. The engaging portion 24 may have any other configuration and include any other form of arcuate surface 42 or other arcuate portion to facilitate pivoting of the engaging portion in accordance with other embodiments of the present disclosure. The spout member 12 also includes a pin 60 on each of its sides for engaging the base member 14 as hereinafter described.

In the illustrated embodiment, the base member 14 is comprised of a top 70 and a lower skirt 72 extending around the perimeter of the top 70. The top 70 comprises engaging structure 80 for engaging the spout member 12 including a pair of opposed wedged shaped walls 82, an arcuate back wall 84 and an arcuate front wall 86 that define a cavity 90 for receiving the spout member 12. The spout member engaging structure 80 also includes a floor configured to complement the configuration of the spout member 12 comprising a neck floor 102 and a arcuate floor 104 to complement the configuration of the arcuate surface 42 of the engaging portion 24. The arcuate floor 104 includes a cam formed by a rupture membrane 110, a rupture support structure 112 and areas or lines of reduced thickness 114 interconnecting the rupture membrane 110 and the rupture support structure 112 configured to be broken. The inside surfaces 120 of the opposed wedge shaped walls 82 define a pair of recesses 122 and includes a pair of dimples 124 for engaging the pins 60 by snap fit to secure the spout member 12 to the base member 14. The base member 14 seals the bottle 16 and prevents fluid flow from the bottle when the spout member 12 is in the closed position. The inside surface of the skirt 72 is threaded to threadingly engage the bottle or may have any other construction to engage to any variety of bottle or other vessel.

During the initial assembly process the spout member 12 is snapped into place over the base member 14 by aligning the pins 60 of the spout member with the recesses 122 of the base member 14 and applying pressure straight down so that the pins 60 of the spout member snap into the dimples 124 defined by the inside surfaces 120 of the base member 14. Since at this time, the rupture membrane 110 has not been ruptured, the base member 14 provides an airtight closure when assembled onto the bottle 16. No liquid can be dispensed at this time.

To activate the closure and allow dispensing of fluid, the dispensing closure 10 uses a pivoting actuation design rather than a pull/push or a screw type activation. By pivoting the spout member 12 relative to the base member 14, the actuator 44 engages the rupture membrane 110, causing the lines of reduced thickness 114 to break and causing the rupture membrane to separate from the rupture support structure 112 but remain hingedly secured to the base member 14 by a living hinge. The continued pivoting of the spout member 12 to a full 90 degrees causes the actuator 44 to travel into the opening defined by the separation of the rupture membrane 110 from the rupture support structure 112, and into the open end of the bottle 16. The fluid flow channel 32 is in communication with the bottle 16. The actuator 44 causes the rupture member 110 to pivot downward. The vent channel 50 now has two open ends, one of which is now open to atmosphere and the other of which is in communication with the vessel 16 through the opening created by the ruptured membrane. The ruptured membrane 110, in its open position, creates a loose seal against the opening of the vent channel in the spout member 12, which creates a check valve and prevents fluid from leaking through the vent channel 50 while allowing air to freely enter the bottle 16.

As fluid is dispensed from the bottle 16, air re-enters through the vent channel 50 to maintain equilibrium. After dispensing the desired fluid, the spout member 12 can then be pivoted to its closed position. This action causes the arcuate surface 42 of the base member 14 to close the open ends of the fluid flow channel 32 and the vent channel 50.

The dispensing closure 10 may be constructed of any suitable plastic or other material, and may have any suitable construction and configuration in accordance with other embodiments of the present disclosure. Similarly, the spout member 12 and base member 14 may be constructed of any suitable plastic or other material, and may have any suitable construction and configuration in accordance with other embodiments of the present disclosure.

The dispensing closure 10 in accordance with an illustrated embodiment of the present disclosure may provide several advantages. For example, the dispensing closure 10 in its assembled state can withstand pressure equal to a conventional flat cap closure. Further, the dispensing closure 10 can be used with vessels containing carbonated beverages. Additionally, pressure can be applied to non-carbonated products to reduce bottle weight, and additional packaging, which results in cost savings. With the present disclosure, the rupture membrane design can be tailored in size and geometry to provide desired flow rates. Further, with the present disclosure, the dispensing closure 10 does not need to be removed from the bottle 16 to activate or operate. Further, the venting feature allows continuous dispensing of fluid without stopping to displace the volume in the vessel. Further, in the closed state, the vent feature is closed automatically and sealed from atmosphere.

While embodiments have been illustrated and described in the drawings and slides and foregoing description, such illustrations and descriptions are considered exemplary and not restrictive in character, it being understood that only illustrative embodiments have been shown and described and that all changes and modifications that come within the spirit of the disclosure are desired to be protected. There is a plurality of advantages of the present disclosure arising from various features set forth in the description. It will be noted that alternative embodiments of the disclosure may not include all of the features described yet still benefit from at least some of the advantages of such features. Those of ordinary skill in the art may readily devise their own implementations of the disclosure and associated methods, without undue experimentation, that incorporate one or more of the features of the disclosure and fall within the spirit and scope of the present disclosure.

What is claimed is:

1. A dispensing closure for a vessel containing fluid comprising a base member engageable with the vessel and a spout member defining a flow channel, the spout member engaged with the base member and pivotable relative to the base member from a closed position to a flow position for dispensing fluid from the vessel through the flow channel, one of the base member and the spout member including a rupture membrane and the other of the base member and the spout member having an actuator for rupturing the rupture membrane during pivoting of the spout member to the flow position to define a flow opening in said one of the base member and the spout member in fluid communication with the flow channel and to permit fluid flow through the flow opening and into the flow channel, the spout member defining a vent channel;

wherein the vent channel includes two openings defined by the spout member, one of the openings in communication with the flow opening when the spout member is pivoted to the flow position and the other one of the openings in communication with the atmosphere to permit air to pass through the vent channel when the spout member is pivoted to the flow position; and wherein the rupture member is positioned adjacent said other of the openings and is configured to function as a check valve to prevent fluid from passing into said one of the openings when the spout member is pivoted to the flow position.

2. The dispensing closure of claim 1 wherein the spout member includes the rupture membrane and the base member has the actuator and wherein the spout member further includes an engaging portion pivotally engaging the base member and having an arcuate surface to facilitate pivoting action and a neck portion extending from the engaging portion, the actuator being disposed on the engaging portion.

3. The dispensing closure of claim 2 wherein the vent channel is defined by the engaging portion.

4. The dispensing closure of claim 3 wherein the vent channel extends through the engaging portion and the engaging portion defines said two openings.

5. The dispensing closure of claim 1 wherein said one of the openings is defined by the actuator.

6. The dispensing closure of claim 1 wherein the vent channel includes a first channel portion that extends substantially parallel to the neck portion and a second channel portion that extends perpendicular to the first channel portion, the second channel portion terminating on one end in said one of the openings.

7. The dispensing closure of claim 6 wherein a diameter of the first channel portion is greater than a diameter of the second channel portion.

8. The dispensing closure of claim 6 wherein said one of the openings is defined by the actuator.

9. The dispensing closure of claim 8 wherein said one of the openings faces a direction perpendicular to the neck portion.

10. The dispensing closure of claim 1 wherein base member includes the rupture membrane.

11. The dispensing closure of claim 10 wherein the rupture membrane is hingedly attached to a portion of the base member after the rupture membrane has been ruptured.

12. The dispensing closure of claim 11 wherein the two openings are defined by the spout member.

13. The dispensing closure of claim 1 further comprising areas of reduced thickness disposed about the rupture membrane configured to be broken when the spout member is pivoted to the flow position to rupture the rupture membrane.

14. The dispensing closure of claim 1 wherein the spout member comprises a flip top spout member.

15. A dispensing closure for a vessel containing fluid comprising:

a base member engageable with the vessel; and a flip top spout member defining a flow channel, the spout member engaged with the base member and pivotable relative to the base member from a closed position to a flow position for dispensing fluid from the vessel through the flow channel, the spout member including an arcuate portion to facilitate pivoting of the spout member relative to the base portion and a neck portion, the spout member including a rupture membrane and the base member having an actuator for rupturing the rupture membrane during pivoting of the spout member to the flow position to define a flow opening in the base member in fluid communication with the flow channel and to permit fluid flow through the flow opening and into the flow channel, the spout member defining a vent channel;

wherein the vent channel includes two openings defined by the spout member, one of the openings in communication with the flow opening when the spout member is pivoted to the flow position and the other one of the openings in communication with the atmosphere to permit air to pass through the vent channel when the spout member is pivoted to the flow position; and wherein the rupture member is positioned adjacent said other of the openings and is configured to function as a check valve to prevent fluid from passing into said one of the openings when the spout member is pivoted to the flow position.

16. The dispensing closure of claim 15 wherein said one of the openings is defined by the actuator.

17. The dispensing closure of claim 16 wherein the vent channel includes a first channel portion that extends substantially parallel to the neck portion and a second channel portion that extends perpendicular to the first channel portion, the second channel portion terminating on one end in said one of the openings.

18. The dispensing closure of claim 17 wherein the rupture membrane is hingedly attached to a portion of the base member after the rupture membrane has been ruptured.

* * * * *